US005555816A

United States Patent [19]

Jones

[11] Patent Number: 5,555,816

[45] Date of Patent: Sep. 17, 1996

[54] SELF STEERING RAILWAY TRUCK

[75] Inventor: Philip A. Jones, Boise, Id.

[73] Assignee: M-K Rail Corporation, Boise, Id.

[21] Appl. No.: 399,198

[22] Filed: Mar. 6, 1995

[51] Int. Cl.[6] ..... B61D 1/00; B61F 5/38

[52] U.S. Cl. ..... 105/168; 105/172; 105/166

[58] Field of Search ..... 105/136, 165, 105/168, 166, 172, 196

[56] References Cited

U.S. PATENT DOCUMENTS

| | | | |
|---|---|---|---|
| 270,985 | 1/1883 | Robertson et al. | 105/165 |
| 1,003,277 | 9/1911 | Lincoln | 105/168 |
| 4,295,428 | 10/1981 | Dickhart, III. et al. | 105/168 |
| 4,765,250 | 8/1988 | Goding | 105/172 X |

FOREIGN PATENT DOCUMENTS

| | | | |
|---|---|---|---|
| 161729 | 11/1985 | European Pat. Off. | 105/168 |
| 84281 | 2/1869 | France | 105/166 |
| 771965 | 11/1954 | United Kingdom | 105/166 |

*Primary Examiner*—Robert J. Oberleitner
*Assistant Examiner*—Kevin D. Rutherford
*Attorney, Agent, or Firm*—Frank J. Dykas

[57] ABSTRACT

A self-steering wheel truck for use with a railway locomotive or powered transit car in which tractive force is transferred from the axles to the frame through traction rods and steering beams connecting with the end axles. The steering beams are interconnected through upstanding shafts pivotally connected to transverse frame members, control arms and resilient curved diagonal alignment arms. The resilient curved alignment arms move the end axles to equal and opposite angulation under compression for a return to parallel operation upon release of self-steering forces.

24 Claims, 9 Drawing Sheets

SELF STEERING RAILWAY TRUCK

BACKGROUND OF THE INVENTION

1. Technical Field

This invention relates to railway vehicles and steering trucks therefor. More particularly, this invention relates to railway locomotives and motorized self-steering radial trucks for locomotive use.

2. Background

Conventional railway truck designs comprising a pair of laterally spaced side frames, at least one transom and a plurality of axle and wheel sets extending transversely there between have become the standard in many railway industry applications. Problems encountered with these conventional trucks include the tendency for the wheel sets to traverse curves in a non-radial orientation and with much wheel flange to rail rubbing contact. Furthermore, the wheel sets may tend to slide during negotiation of track curves. Such rubbing contact and wheel sliding result in undesirable high wheel and rail wear, and the flange rubbing in particular may produce a tendency for the wheel to climb the rail. Improper wheel set tracking in curves may also result in track misalignment. Additionally, curved track imposes lateral forces on the wheel sets tending to displace them laterally off the truck center line, as shown in FIG. 1. These lateral forces cause increased wear of wheel set bearings and other truck components.

Other related problems occur when conventional trucks traverse straight, or tangent, runs of track. For example, a rigid wheel axle set, having conventional tapered conical wheels, when displaced laterally from the center line of a run of straight track, executes two simultaneous motions; first, the wheel set moves toward its equilibrium (center) position under the influence of gravity, and secondly, the high side wheel, rolling on a larger diameter than the low side wheel, moves along the rail faster than its partner, causing the wheel set to yaw. Given the proper set of circumstances, this motion may become a sustained harmonic oscillation known as hunting. The hunting tendency is transmitted to the truck and causes an oscillatory yawing motion of the truck about its center of rotation, resulting in additionally high truck component, wheel and rail wear.

These problems have been recognized in the prior art and a variety of self steering railway truck designs have been devised which purport to allow the wheel sets to track without sliding and without undue flange rubbing 25 during negotiation of curves, and with minimal adverse consequences resulting from hunting.

One example is Goding, U.S. Pat. No. 4,765,250, which teaches a method for inducing an "equal and opposite" rotation, or yaw, of one truck axle in response to the yawing of another truck axle when the truck is encountering a curve. Four traction rods, rotatably connected to the two axles near each wheel, and connected at their other ends to two transversely mounted steering arms transmit the tractive force to a lower end of respective vertical shafts. Attached to the top of each of the vertical shafts are opposing crank arms which themselves are interconnected by a diagonal alignment arm. As one axle yaws, that yawing motion is transmitted via the traction rods, steering arm, vertical shaft, crank arm and diagonal alignment arm to induce a purported "equal and opposite" yawing motion in the other axle.

Equal and opposite yawing of the two axles is required for the two wheel sets to accurately follow a curved track of constant radius, as shown in FIG. 2. It can be demonstrated trigonometrically, however, as shown in FIGS. 3 and 4, that the rigid diagonal connecting link of Goding cannot induce an "equal and opposite" rotation of the axles.

Referring to FIGS. 3 and 4, the free body diagram of FIG. 3 depicts the Goding two axle, diagonal connecting link steerable truck of the present invention in parallel axle, straight track operation. It is a four pin, one link system, wherein tractive force is transmitted from the wheels to the truck frame through pins $P_1$ and $P_2$ about which axles 28 and 29 approximately pivot. Pins $P_3$ and $P_4$ are used to transmit axle rotating forces through diagonal link 37. First and second axles 28, 29 respectively, are separated by a longitudinal distance L and are pivotally connected by diagonal link 37 having length $l_s$. FIG. 4 shows the steerable truck of FIG. 3 during curved track operation wherein an angulation of degree $\theta_1$ has been induced in first axle 28. Diagonal link 37 has length $l_c$. Through displacement of link 37, an opposite angulation of degree $\theta_2$ is induced in axle 29. The trigonometric proof that equal and opposite angulation of axle 29 cannot occur, is as follows:

Referring to FIGS. 3 and 4:

R=distance from center of axle to a wheel

L=distance between axles $l_s$=length of diagonal arm during straight track operation $l_c$=length of diagonal arm during curved track operation $\theta_1$=yaw angle of front axle during curved track operation $\theta_2$=yaw angle of rear axle during curved track operation $$l_s^2=L^2+(2R)$$

$$l_s=[L^2+4R_2]^{1/2}$$

Referring now specifically to FIG. 4 (induced angulation) with origin (0,0) at the center of axle 28

$$\begin{aligned}
l_c &= [(X_1-X_2)^2+(Y_1-Y_2)^2]^{1/2} \\
X_1 &= R\sin\theta_1 \quad X_2=L+R\sin\theta_2 \\
Y_1 &= R\cos\theta_1 \quad Y_2=-R\cos\theta_2 \\
l_c &= 8\,[R\sin\theta_1-(L+R\sin\theta_2)]^2+[R\cos\theta_1-(-R\cos\theta_2)]2^{1/2} \\
&= 8\,[(R(\sin\theta_1-\sin\theta_2)-L]^2+[R(\cos\theta_1+\cos\theta_2)]2^{1/2} \\
&\quad \text{for equal and opposite angulation } \theta_1=\theta_2=\theta \\
l_c &= 8\,[R(0)-L]^2+(2R\cos\theta]^{21/2} \\
&= [L^2+4R^2\cos^2\theta]^{1/2}
\end{aligned}$$

For all $0<\theta<90°$: $4R^2\cos^2\theta<4R^2$

Therefore $l_c<ls$ for equal and opposite angulation of the two axles. It is necessarily true, then, that for $l_c=l_s$(a rigid diagonal connecting link), equal and opposite angulation cannot occur. It is only by accidental, or incidental, tolerance "slop", that the Godinq design works. Adding a second rigid diagonal connecting link at the opposite set of opposing axle ends will bind the system.

Considerable other prior work has been done in the area of self steering railway trucks, but no design enjoys the advantageous features of the present invention. Designs which have employed a direct mechanical diagonal linking of the ends of two axles are inherently incapable of producing equal and opposite axle alignment, and would bind up in operation were there not enough slop in the system to allow the axles to give.

Accordingly, it is an object of this invention to provide a self-steering railway truck in which a true "equal and opposite" rotation of the end axles occurs, so that a curved railway truck track path is accurately followed, thereby minimizing wheel and rail wear.

Another object of the present invention is to provide a self-steering railway truck in which hunting, with its concomitant adverse affects, is minimized, by minimizing axle and wheel set yawing and lateral displacement during straight track operation.

It is a further object of the present invention to provide a self-steering railway truck in which the angulated end axles have an inherent tendency to return to straight track operation when straight track is encountered after self-steering operation on a curved section of track.

Yet another object of the present invention is to provide a self-steering railway truck which automatically self- adjusts, or compensates, for wheel, self-steering apparatus, or other truck component wear.

DISCLOSE OF INVENTION

These and other objects are accomplished by an improved self-steering railway truck, in which the end axles are interconnected so that an angulation of the first end axle induces a true equal and opposite rotation of the second end axle. The invention comprises steering beams pivotally connected with the end axles via traction rods and fixably attached at their centers to upstanding tractive force shafts pivotally mounted on adjacent transoms. The force shaft carries control arms which are connected by diagonally-crossing, curved resilient axle alignment arms. The curved, resilient arms move the end axles to equal and opposite angulation under compression for a return to parallel operation upon release of the self-steering forces. Automatic compensation for component wear, as well as reduced straight-track yawing comprise other advantages of the curved, resilient axle alignment arms.

These and other features and advantages of the invention will be more fully understood in the following description of a preferred embodiment of the invention, taken together with the accompanying drawings.

BEST MODE FOR CARRYING OUT INVENTION

Figure 5:
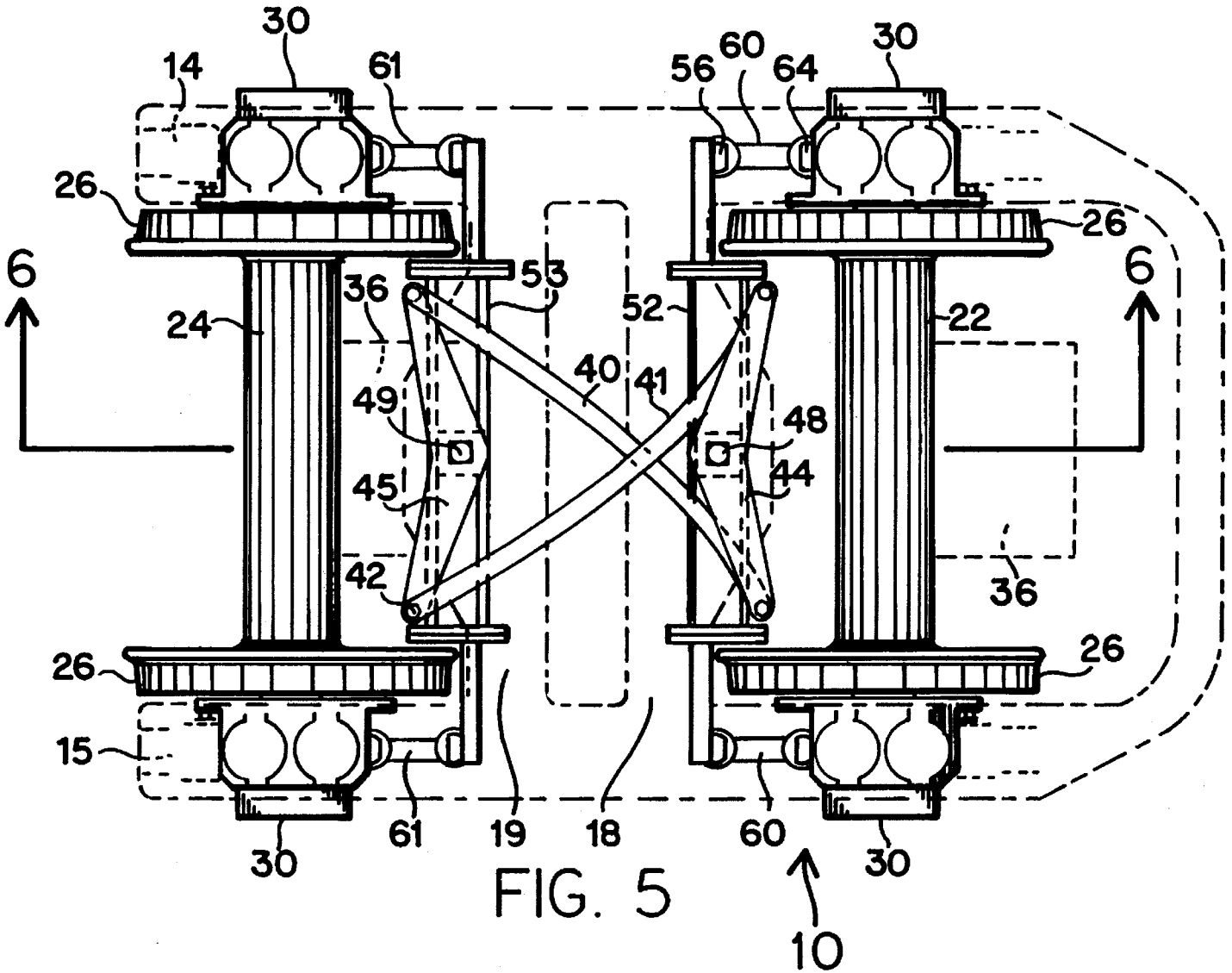
FIG. 5 is a plan view of a two axle self-steering motorized railway truck with features in accordance with the present invention with parts broken away for clarity.
Figure 6:
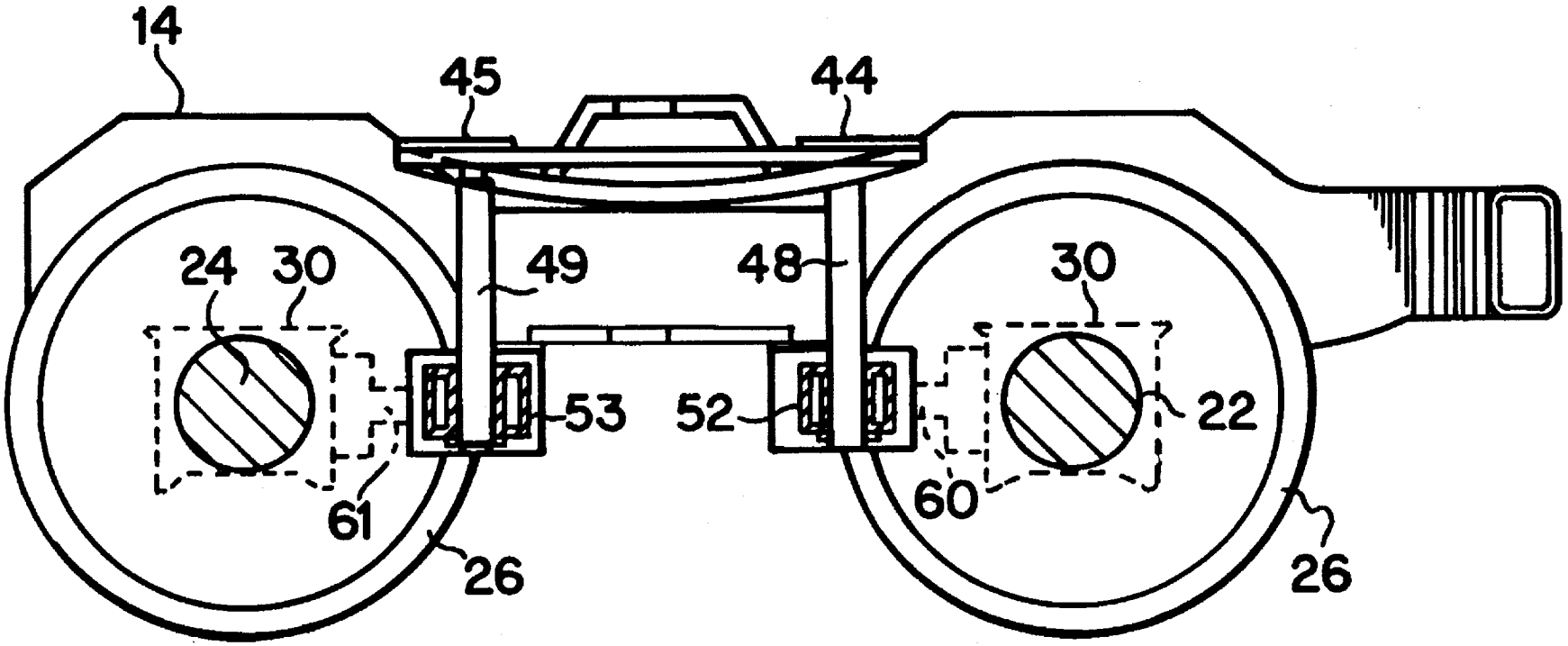
FIG. 6 is a side cross sectional view through line 6—6 of the truck of FIG. 5 with parts broken away for clarity.

The invention may be embodied in rail trucks having various number of axles. Referring now to FIGS. 5 and 6, numeral 10 generally indicates a two axle self steering railway locomotive or power transit truck of this invention. The truck 10 includes a pair of generally parallel laterally spaced longitudinally extending side frames 14, 15, interconnected by at least two longitudinally spaced transversely extending transoms 18, 19.

The wheels 26 are arranged in transversely spaced pairs each connected to one of the axles 22, 24 to form longitudinally spaced wheel and axle assemblies. Preferably, as illustrated, the axles 22, 24 are longitudinally spaced at equal distances from the transoms 18, 19. The truck side frames 14, 15 are rotatably supported on the ends of the front and rear axles 22, 24, respectively, atop bearing housings 30. For powering the wheel and axle assemblies, the truck is provided with two traction motors 36, one driving each axle. Each motor is supported by conventional bearing means on its respective axle, and is carried from one of the adjacent transoms.

Self-steering action of the wheel and axle assemblies while transmitting traction and braking forces between the wheel and axle assemblies and the truck frame, is accomplished by means of a traction and steering linkage assembly formed in accordance with the invention. This traction and steering linkage assembly includes transversely extending front and rear steering beams 52, 53, respectively, which are pivotally connected at their centers with the bottom of the transoms 18, 19 respectively, as will be subsequently more fully described. The terms front and rear are used for descriptive purposes only, as the truck may be operated equally well in either direction of operation.

Figure 1:
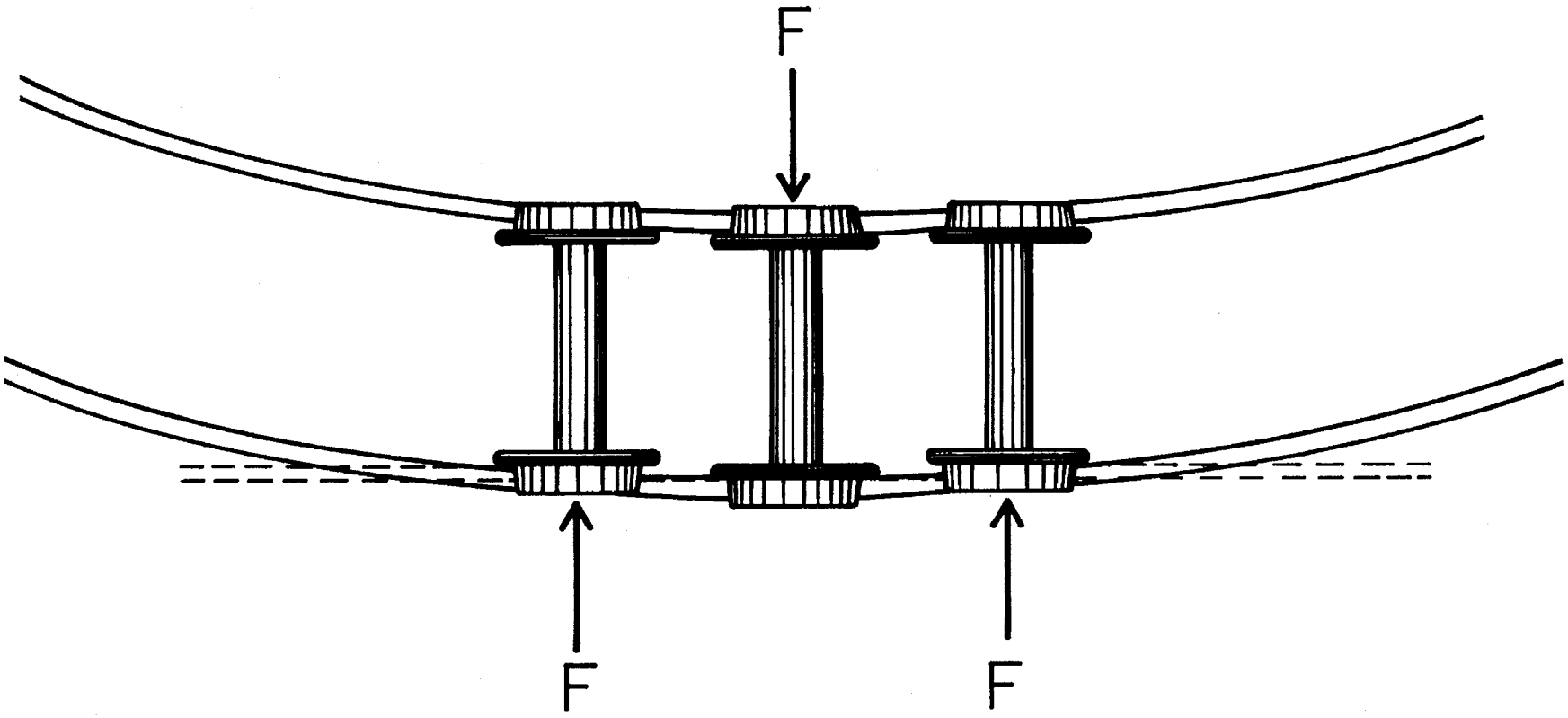
FIG. 1 is a plan view schematic representation of a conventional three-axle rail truck negotiating a curved track, showing lateral displacement of the axles with lateral forces on the truck indicated by the letter "F".
Figure 2:
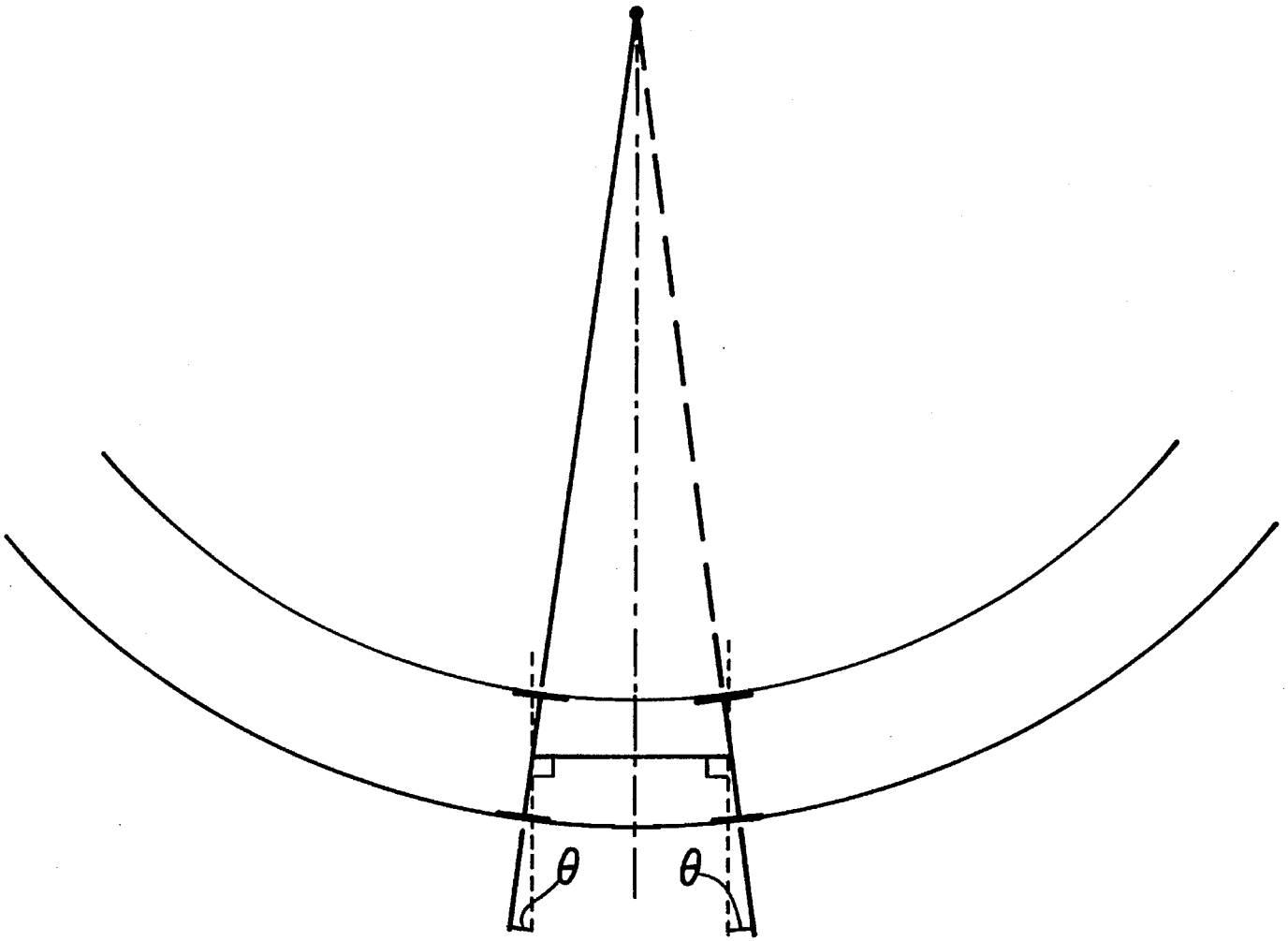
FIG. 2 is a plan view schematic representation of a conventional, self-steering two-axle rail truck negotiating a curved track.
Figure 3:
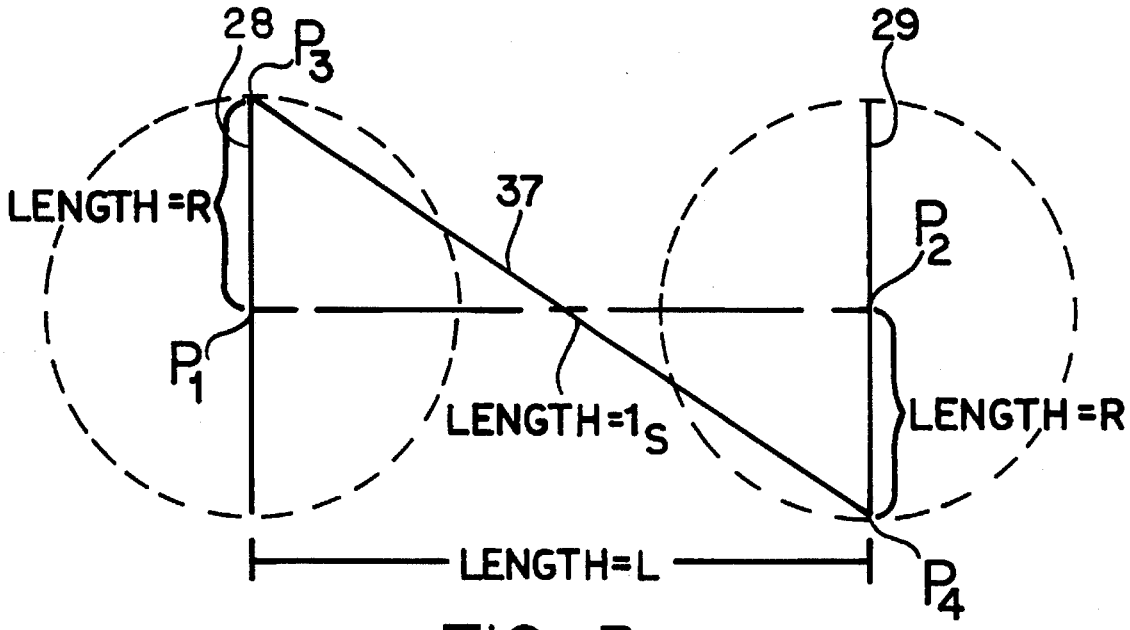
FIG. 3 is a plan view free body diagram representing the end axles of a steerable rail truck connected by a single diagonal connecting link, in straight track, parallel axle operation.
Figure 4:
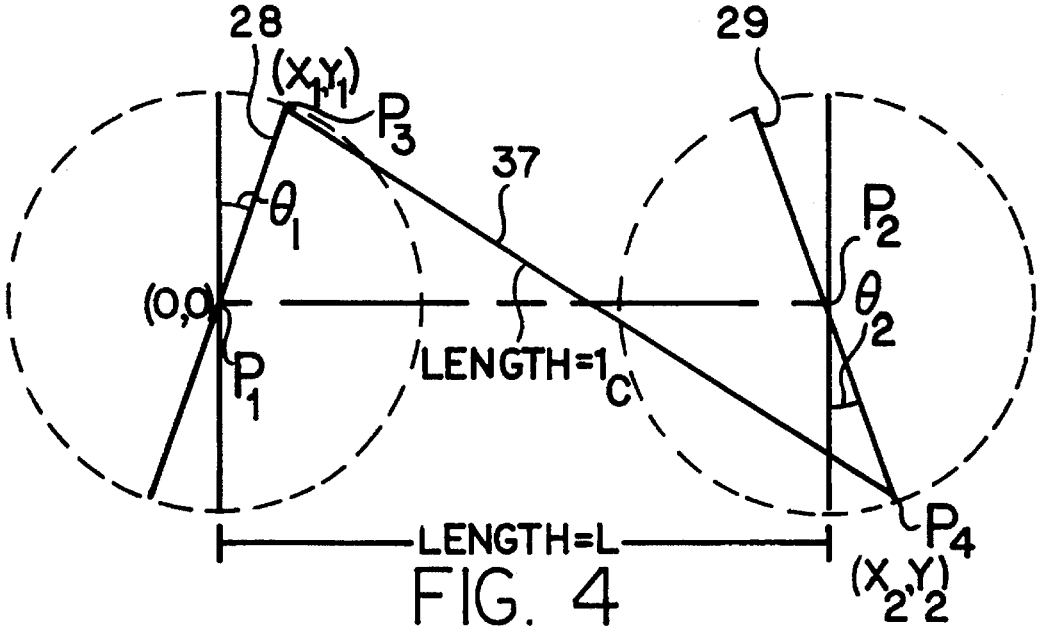
FIG. 4 is a plan form free body diagram of the rail truck of FIG. 3 when an angulation of degree $\theta_1$ has been induced in one axle.

Opposite ends of the front and rear steering beams 52, 53 are, respectively, connected with journal housings 30 on both ends of the front and rear axles 22, 24, respectively, by pairs of pivotally attached front and rear traction rods 60, 61, respectively. Steering beams 52, 53 are fixedly attached to vertically oriented tractive force shafts 48, 49 which extend vertically upward through, and are pivotally attached to, transoms 18, 19. Though free to rotate within transoms 18 and 19, vertically oriented force shafts 48 and 49 transmit tractive forces to the transoms 18 and 19 through their bearings. Vertical shafts 48, 49 correspond in a functional sense to pins $P_1$ and $P_2$ in FIGS. 3 and 4, and in FIGS. 7 and 8. The upper ends of generally vertical tractive force shafts 48, 49 are fixedly attached to control arms 44, 45, respectively. Opposite ends of front and rear control arms 44, 45, are oppositely and diagonally connected by diagonal curved, resilient axle alignment arms 40, 41.

Steering beams 52, 53, angled traction rods 60, 61, control arms 44, 45 and resilient alignment arms 40, 41 are so arranged as to require equal and opposite yawing (steering) motions of the front and rear axle assemblies so as to provide efficient inter-related, self-steering actions of the end axles. These components, with the vertically oriented tractive force shafts 48 and 49, also comprise a force transmitting linkage which carries the traction forces between the axles and the truck frame. The vertically oriented tractive force shafts 48 and 49 transfer yaw motion by their rotation, and transmit tractive forces through their bearings.

True equal and opposite yawing (steering) motions of the front and rear axle assemblies are achieved by means of the novel diagonal curved resilient axle alignment arms 40, 41 of the invention. Because arms 40, 41 are resilient, they are able to flex and therefore vary the effective distance between their respective end points. This length variation property geometrically permits true equal and opposite yawing motion of the front and rear axle assemblies, thereby permitting the self-steering truck to accurately follow a curved track and minimize wear of the wheels and rail.

Figure 7:
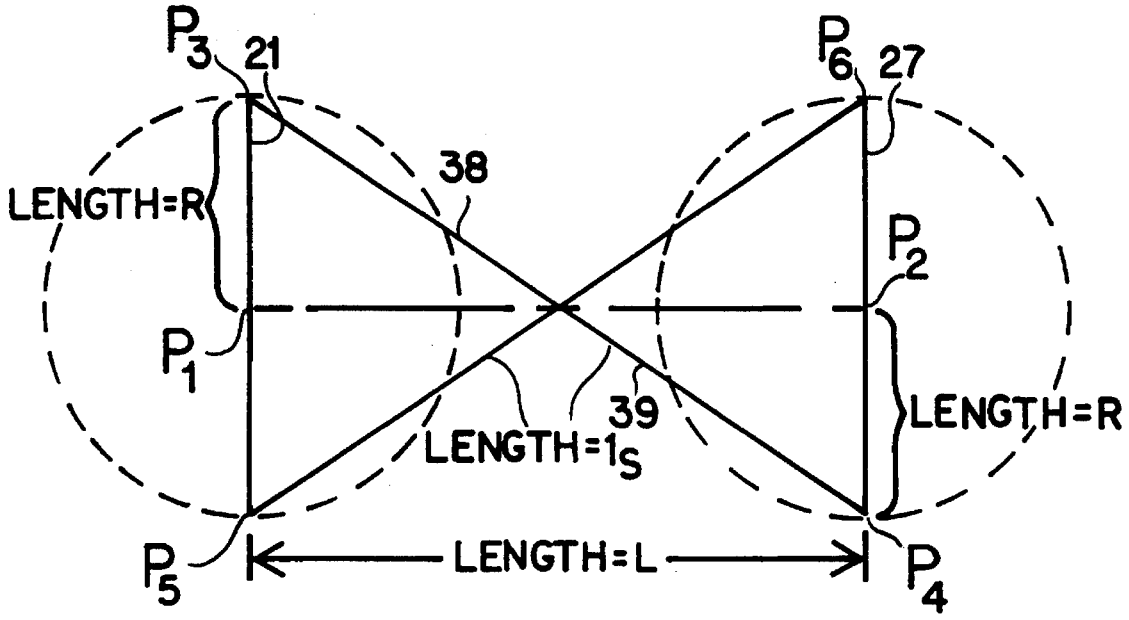
FIG. 7 is a plan view free body diagram representing the end axles of a steerable rail truck connected by two diagonal, resilient alignment arms during parallel axle, straight track operation.
Figure 8:
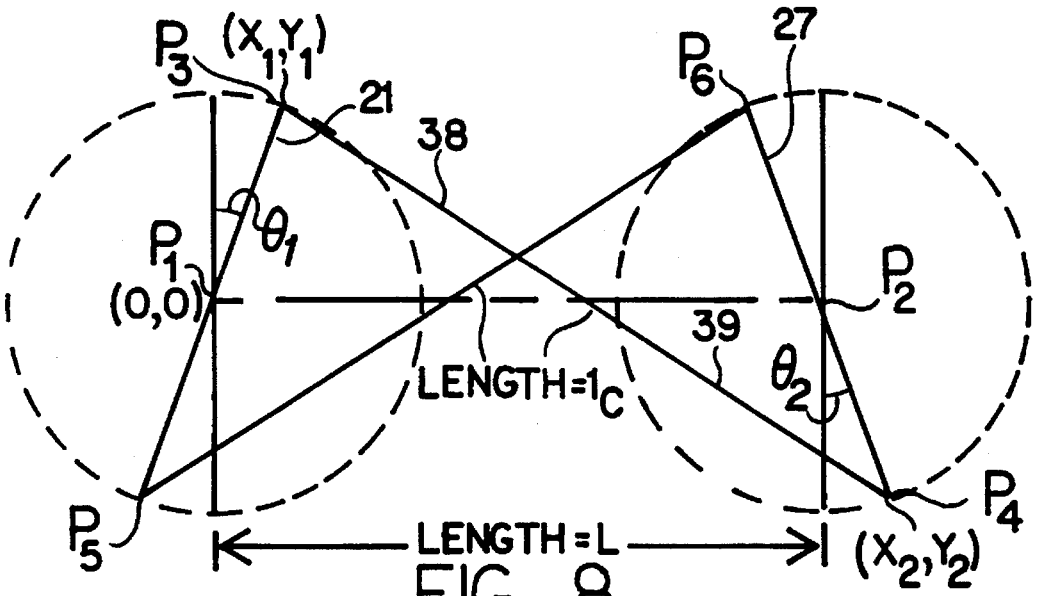
FIG. 8 is a plan view free body diagram of the truck of FIG. 5 when an angulation of degree $\theta_1$ has been induced in one axle.

Referring to FIGS. 7 and 8, the free body diagram of FIG. 7 depicts the six pin, two axle, diagonal alignment arm steerable truck of the present invention in parallel axle, straight track operation. First and second axles 21, 27 respectively, are separated by a longitudinal distance L and are pivotally connected by diagonal arms 38, 39 each having length $l_s$. As in the prior art, tractive force is transmitted through axle pivot pins $P_1$ and $P_2$. However, two resilient diagonal links 38 and 39 are provided, interconnected to axles 21 and 27 at pivot points $P_3$, $P_5$ and $P_4$, $P_6$. FIG. 8 shows the steerable truck of FIG. 7 during curved track operation wherein an angulation of degree $\theta_1$ has been induced in first axle 21. Diagonal arms 38, 39 each have length $l_c$. Through displacement of arms 38, 39 an opposite angulation of degree $\theta_2$ is induced in axle 27. It can be trigonometrically demonstrated that to induce an equal and opposite angulation in axle 27 (i.e., for $\theta_1=\theta_2$), arms 38, 39 must decrease in length. The proof for arm 38 is as follows: Referring to FIGS. 7 and 8:

R=distance from center of axle to a wheel

L=distance between axles $l_s$=length of diagonal arm during straight track operation $l_c$=length of diagonal arm during curved track operation $\theta_1$=yaw angle of front axle during curved track operation $\theta_2$=yaw angle of rear axle during curved track operation $$l_s^2L^2+(2R)^2$$

$$l_s=[L^2+4R^2]^{1/2}$$

Referring now specifically to FIG. 8 (induced angulation) with origin (0,0) at the center of axle 21

$$\begin{aligned}
l_c &= [(X_1-X_2)^2+(Y_1-Y_2)^2]^{1/2} \\
X_1 &= R\sin\theta_1 \quad X_2=L+R\sin\theta_2 \\
Y_1 &= R\cos\theta_1 \quad Y_2=-R\cos\theta_2 \\
l_c &= 8\,[R\sin\theta_1-(L+R\sin\theta_2)]^2+[R\cos\theta_1-(-R\cos\theta_2)]2^{1/2} \\
&= 8\,[(R(\sin\theta_1-\sin\theta_2)-L]^2+[R(\cos\theta_1+\cos\theta_2)]2^{1/2} \\
&\quad \text{for equal and opposite angulation } \theta_1=\theta_2=\theta \\
l_c &= 8\,[R(0)-L]^2+(2R\cos\theta]^{21/2} \\
&= [L^2+4R^2\cos^2\theta]^{1/2}
\end{aligned}$$

For all $0<\theta<90°$:$4R^2\theta<4R^2$

Therefore $l_c<l_s$. The proof for arm 39 is similar. Thus it is apparent that for true equal and opposite angulation of the axles arms 38, 39 must decrease in length. This decrease in length is achieved by the flexing property of the diagonal arms of this invention.

Further advantages of the invention are achieved as a result of the curved shape and flexing property of resilient diagonal alignment arms 40, 41, and by the manner in which these arms are mounted to control arms 44, 45. Alignment arms 40, 41 are compression loaded during installation and attachment to control arms 44, 45. Thus, there is a spring force tending to straighten the arms, and which, through the action of control arms 44, 45, vertical shafts 48, 49, steering beams 52, 53, and connecting rods 60, 61, provide forces which tend to return the front and rear axle assemblies to a parallel, straight-track configuration after angulated, curved-track operation or other externally induced yawing. This minimizes undesired yawing and hunting with its adverse affects.

Providing two, diagonally crossed, symmetric resilient alignment arms 40, 41, insures that the forces on the front and rear axle assemblies are symmetrical and tend always to return the axle assembly to parallel, straight track alignment whenever they are perturbed, due to hunting, curved track, or other externally-induced effects.

An additional, advantageous effect of compression loaded, diagonally crossed, symmetric resilient alignment arms 40, 41, is automatic wear compensation. As the wheel bearings, steering linkages and other parts of the rail truck wear, the diagonally crossed resilient alignment arms will expand in length as necessary to make up for the looseness, or space, between worn parts. In this way, the axle and wheel assemblies are always biased for parallel straight track operation, with yawing and hunting minimized. At the same time, the self-steering property of the truck is preserved.

Figure 9:
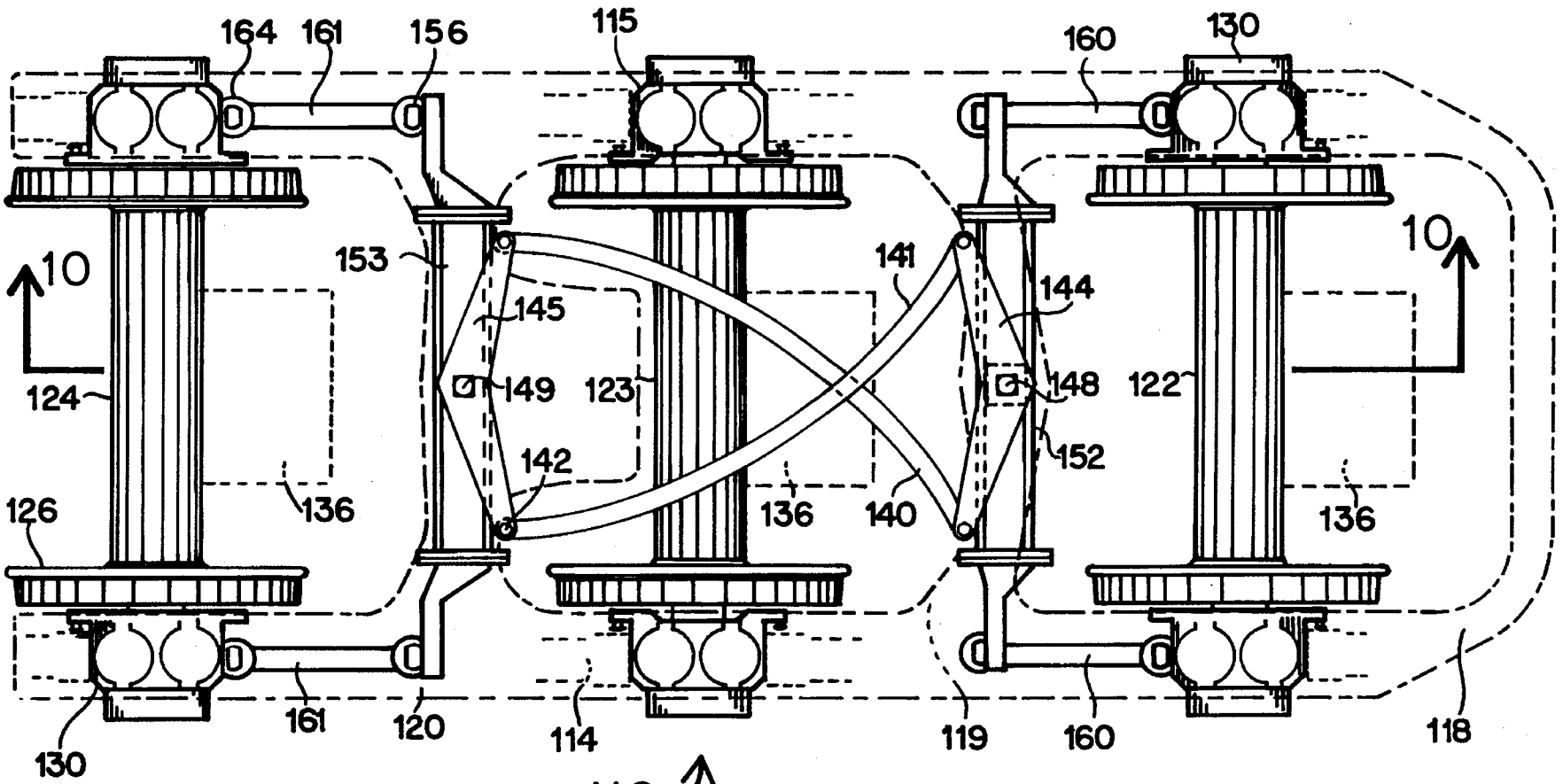
FIG. 9 is a plan view of a three axle self-steering motorized railway truck with features in accordance with the present invention with parts broken away for clarity.
Figure 10:
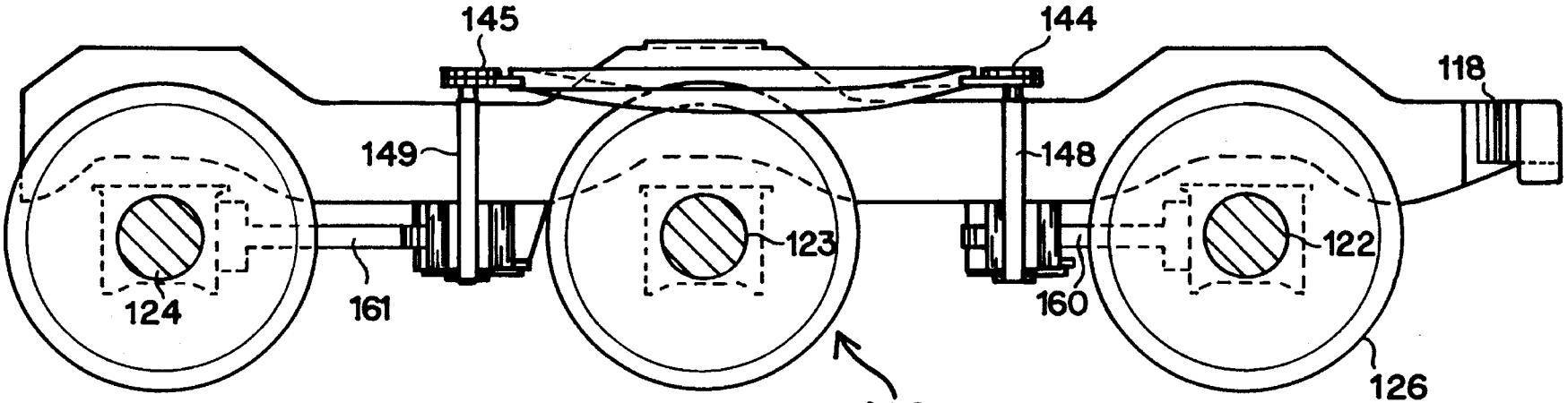
FIG. 10 is a side cross sectional view through line 10—10 of the truck of FIG. 9 with parts broken away for clarity.

Reference is now had to FIGS. 9 and 10, wherein a three axle embodiment of the invention is depicted. Numeral 110 generally indicates the three axle self steering railway truck of this invention. The truck 110 includes a pair of generally parallel laterally spaced longitudinally extending side frames 114, 115, interconnected by three longitudinally spaced transversely extending transoms 118, 119, 120.

The wheels 26 are arranged in transversely spaced pairs each connected by one of the axles 122, 123, 124 to form longitudinally spaced wheel and axle assemblies. Preferably, the longitudinal spacing of the wheel and axle assemblies is equal, as illustrated, and the axles 122, 123, 124 are longitudinally spaced at equal distances from the transoms 118, 119, 120. The truck side frames 114, 115 are rotatably supported on the ends of the front, center and rear axles 122, 123, 124, respectively, via bearing housings 130.

For powering the wheel and axle assemblies to drive the locomotive, the truck is provided with three traction motors 136, one driving each axle. Each motor is supported by conventional bearing means on its respective axle, and is carried from one of the adjacent transoms.

Self-steering action of the wheel and axle assemblies while transmitting traction and braking forces between the wheel and axle assemblies and the truck frame, is accomplished by means of a traction and steering linkage assembly formed in accordance with the invention. This traction and steering linkage assembly includes transversely extending front and rear steering beams 152, 153, respectively, which are pivotally connected at their centers with the bottom of the transoms 119, 120 respectively, as will be subsequently more fully described. The terms front and rear are used for descriptive purposes only, as the truck may be operated equally well in either direction of operation.

Opposite ends of the front and rear steering beams 152, 153 are, respectively, connected with bearing housings 130 on both ends of the front and rear end axles 122, 124, respectively, by pairs of pivotally attached front and rear angled traction rods 160, 161, respectively. Steering beams 152, 153 are fixedly attached to vertical shafts 148, 149 which extend vertically upward through, and rotatably attached to, transoms 119, 120. The upper end of generally vertical tractive force shafts 148, 149 are fixedly attached to control arms 144, 145, respectively. Opposite ends of front and rear control arms 144, 145, are oppositely and diagonally connected by diagonal curved, resilient axle alignment arms 140, 141.

Steering beams 152, 153, angled traction rods 160, 161, control arms 144, 145 and resilient alignment arms 140, 141 are so arranged as to require equal and opposite yawing (steering) motions of the front and rear axle assemblies so as to provide efficient inter-related, self-steering actions of the end axles. These components also comprise a force transmitting linkage which carries the traction forces between the axles and the truck frame.

True equal and opposite yawing (steering) motions of the front and rear axle assemblies are achieved by means of the novel diagonal curved resilient axle alignment arms 140, 141 of the invention. Because arms 140, 141 are resilient, they are able to flex and therefore vary the effective distance between their respective end points. This length variation property geometrically permits true equal and opposite yawing motion of the front and rear axle assemblies, thereby permitting the self-steering truck to accurately follow a curved track and minimize wear of the wheels and rail.

Referring to FIGS. 7 and 8, the free body diagram of FIG. 7 depicts the two end axles of a diagonal alignment arm steerable truck of the present invention in parallel axle, straight track operation. First and second end axles 21, 27 respectively, are separated by a longitudinal distance L and are pivotally connected by diagonal arms 38, 39 each having length is. FIG. 8 shows a steerable truck of FIG. 7 during curved track operation wherein an angulation of degree $\theta_1$ has been induced in first axle 21. Diagonal arms 38, 39 each have length $l_c$. Through displacement of arms 38, 39 an opposite angulation of degree $\theta_2$ is induced in axle 27. It can be trigonometrically demonstrated that to induce an equal and opposite angulation in axle 27 (i.e., for $\theta_1=\theta_2$), arms 38, 39 must decrease in length. The proof for arm 38 is as follows:

Referring to FIGS. 7 and 8:

R=distance from center of axle to a wheel

L=distance between axles $l_s$=length of diagonal arm during straight track operation p1 $l_c$=length of diagonal arm during curved track operation $\theta_1$=yaw angle of front axle during curved track operation $\theta_2$=yaw angle of rear axle during curved track operation $$l_s^2=L^2+(2R)^2$$

$$l_s=[L^2+4R^2]^{1/2}$$

Referring now specifically to FIG. 8 (induced angulation) with origin (0,0) at the center of axle 21

$$l_c = [(X_1-X_2)^2+(Y_1-Y_2)^2]^{1/2}$$

$$X_1 = R\sin\theta_1 \quad X_2 = L+R\sin\theta_2$$

$$Y_1 = R\cos\theta_1 \quad Y_2 = -R\cos\theta_2$$

$$l_c = 8\,[R\sin\theta_1-(L+R\sin\theta_2)]^2+[R\cos\theta_1-(-R\cos\theta_2)]^{21/2}$$

$$= 8\,[(R(\sin\theta_1-\sin\theta_2)-L]^2+[R(\cos\theta_1+\cos\theta_2)]^{21/2}$$

for equal and opposite angulation $\theta_1=\theta_2=\theta$ $$l_c = 8\,[R(0)-L]^2+(2R\cos\theta]^{21/2}$$

$$= [L^2+4R^2\cos^2\theta]^{1/2}$$

For all $0<\theta<90°$:$4R^2COS^2\theta<4R^2$

Therefore $l_c<l_s$.

The proof for arm 39 is similar. Thus it is apparent that for true equal and opposite angulation of the axles arms 38, 39 must decrease in length. This decrease in length is achieved by the flexural property of the diagonal arms of this invention.

Further advantages of the invention are achieved as a result of the curved shape and flexing property of resilient diagonal alignment arms 40, 41, and by the manner in which these arms are mounted to control arms 144, 145. Alignment arms 140, 141 are compression loaded during installation and attachment to control arms 144, 145. Thus, there is a spring force tending to straighten the arms, and which, through the action of control arms 144, 145, vertical shafts 148, 149, steering beams 152, 153, and connecting rods 160, 161, provide forces which tend to return the front and rear axle assemblies to a parallel, straight-track configuration after angulated, curved-track operation or other externally induced yawing. This minimizes undesired yawing and hunting with its adverse affects.

Providing two, diagonally crossed, symmetric resilient alignment arms 140, 141, insures that the forces on the front and rear axle assemblies are symmetrical and tend always to return the axle assembly to parallel, straight track alignment whenever they are perturbed, due to hunting, curved track, or other externally-induced effects.

An additional, advantageous effect of compression loaded, diagonally crossed, symmetric resilient alignment arms 140, 141, is automatic wear compensation. As the wheel bearings, steering linkages and other parts of the rail truck wear, the diagonally crossed resilient alignment arms will expand in length as necessary to make up for the looseness or space between worn parts. In this way, the axle and wheel assemblies are always biased for parallel straight track operation, with yawing and hunting minimized. At the same time, the self-steering property of the truck is preserved.

While the arrangement is disclosed in connection with self-steering trucks, it should be understood that features of the arrangement could also be applied to so called forced steering railway trucks, wherein the steering mechanism is interconnected directly with the vehicle or locomotive car body to inter-relate the steering movements of the axles with the yawing motion of the frame relative to the car body. Thus, while the described arrangement is free of direct connections between the steering linkage and the car body, the features of the invention are not so limited.

Figure 11:
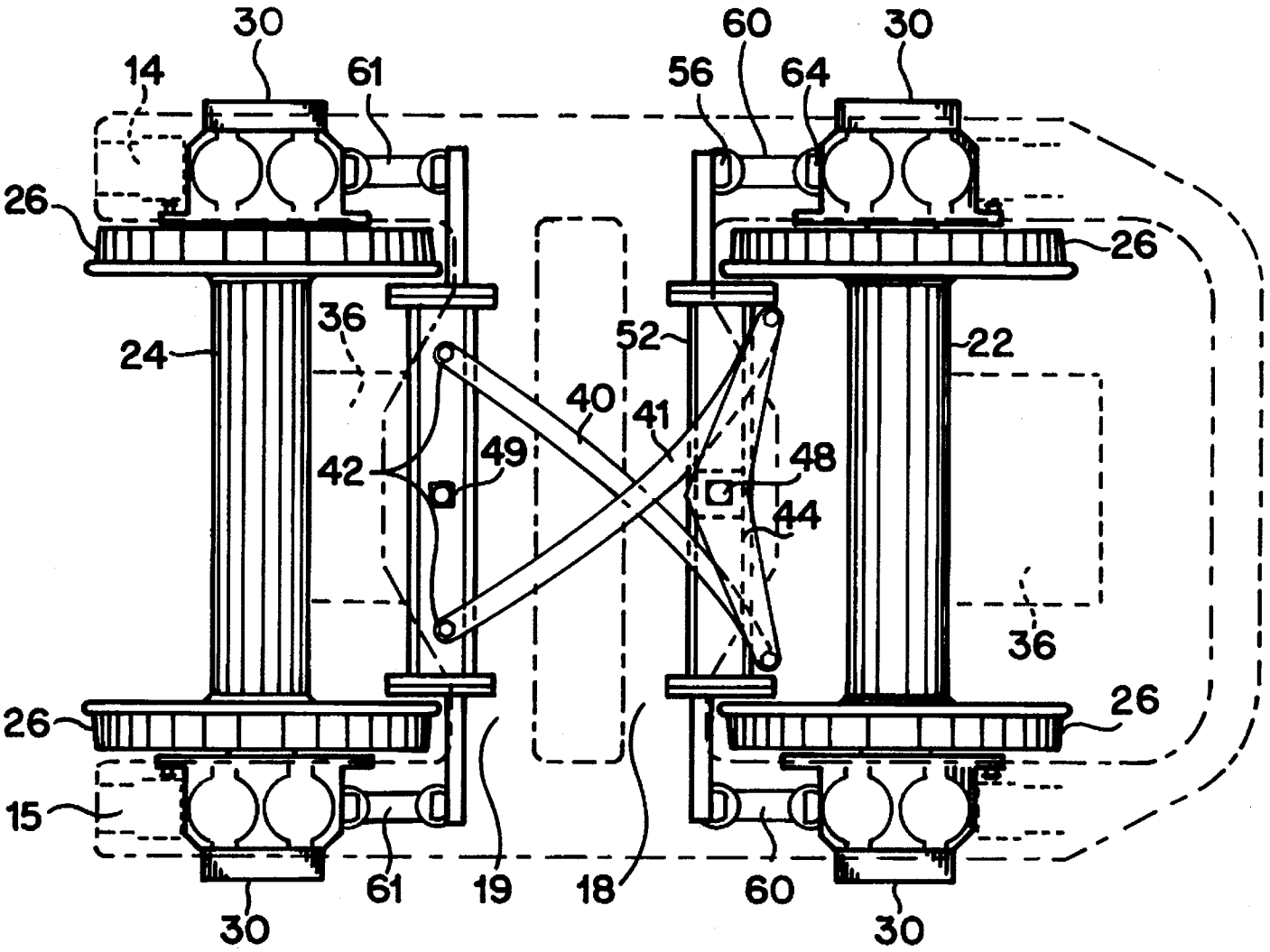
FIG. 11 is a plan view of a two axle self-steering motorized railway truck in accordance with the present invention with one end of the curved alignment arms pinned to the frame and with parts broken away for clarity.

Furthermore, in other embodiments of the invention, the diagonally crossed, symmetric resilient alignment arms 40, 41 (or 140, 141 for the 3-axle truck) could be configured between only one axle and a part of the truck frame. FIG. 11 depicts one such embodiment in which diagonal alignment arms 40, 41 interconnect axle 22 with transom 19 at pivot pins 42. Multiple sets of alignment arms, one set for each axle, could be so provided. Though the induced forced angulation effect between axles would thereby be lost, these embodiments still enjoy the other benefits, described above, provided by the diagonally crossed, symmetric resilient alignment arms.

While the invention has been described by reference to certain preferred embodiments, it should be understood that numerous changes could be made within the sphere and scope of the inventive concepts described. Accordingly, it is intended that the invention not be limited to the disclosed embodiment, but that it have the full scope permitted by the language of the following claims.

I claim:

1. An improved self-steering wheel truck for use with a railway locomotive or powered transit car, said self-steering wheel truck including first and second longitudinally spaced wheel and axle assemblies, each having a pair of opposing wheels interconnected by an axle, a truck frame including a pair of parallel side frames, defining a longitudinal axis, interconnected by at least two transverse frame members, defining a transverse axis, means for rotatably carrying said truck frame on said first and second axle and wheel assemblies and permitting axle yaw for both the first and second axles, tractive force motors drivedly connected to the axles for driving the wheels, wherein the improvement comprises:

a pair of generally vertically oriented tractive force transmitting shafts each connected to an axle and pivotally mounted to one of the transverse frame members for transmitting tractive force from the axle and wheel assembly to the truck frame and for rotation in response to axle yaw; and a pair of diagonally disposed resilient axle alignment arms, each connected to the first axle adjacent to a wheel and diagonally connected to the second axle adjacent to the corresponding opposing wheel, for transmitting, by flexing, an opposite axle yaw inducing force to the second axle responsive to a force externally inducing self-steering yaw of the first axle, and for urging said first and second axles into parallel spaced relationship upon removal of the externally induced self-steering yaw force.

2. The improved self-steering wheel truck of claim 1 wherein the means for connecting the vertically oriented tractive force transmitting shafts to the axle and wheel assemblies further comprises:

a pair of transversely oriented steering beams each for positioning in fixed parallel juxtaposed relationship to an axle;

means for positioning each steering beam in fixed parallel juxtaposed relationship to an axle;

means for attaching a vertically oriented tractive force transmitting shaft to the center point of each steering beam.

3. The improved self-steering wheel truck of claim 2 wherein the means for positioning each steering beam in fixed parallel juxtaposed relationship to an axle further comprises:

a pair of connecting rods each interconnecting said steering beam to said axle.

4. The self-steering wheel truck of claim 3 wherein the diagonally disposed resilient axle alignment arms are curved.

5. The self-steering wheel truck of claim 3 wherein the diagonally disposed resilient axle alignment arms are pre-loaded in compression.

6. The improved self-steering wheel truck of claim 2 which further comprises:

a pair of generally transverse control arms each fixedly connected, in opposing relationship, to an upper end of a generally vertically oriented tractive force transmitting shaft; and means for connecting the pair of diagonally disposed resilient axle alignment arms to opposite ends of the opposing control arms for transmitting, under compression, an opposite axle yaw inducing force to the second axle responsive to a force externally inducing self-steering yaw of the first axle, and for urging said first and second axles into parallel spaced relationship upon removal of the externally induced self-steering yaw force.

7. The self-steering wheel truck of claim 6 wherein the pair of diagonally disposed resilient axle alignment arms are curved.

8. The self-steering wheel truck of claim 6 wherein the pair of diagonally disposed resilient axle alignment arms are pre-loaded in compression.

9. The improved self-steering wheel truck of claim 6 wherein the means for rotatably carrying the truck frame on the associated axle and wheel assembly comprises bearing housings.

10. The self-steering wheel truck of claim 2 wherein the pair of diagonally disposed resilient axle alignment arms are curved.

11. The self-steering wheel truck of claim 2 wherein the pair of diagonally disposed resilient axle alignment arms are pre-loaded in compression.

12. The improved self-steering wheel truck of claim 2 wherein the means for rotatably carrying the truck frame on the respective axle and wheel assembly comprises bearing housings.

13. The improved self-steering wheel truck of claim 1 which further comprises:

a pair of generally transverse control arms each fixedly connected, in opposing relationship, to an upper end of a generally vertically oriented tractive force transmitting shaft; and means for connecting the pair of diagonally disposed resilient axle alignment arms to opposite ends of the opposing control arms for transmitting, under compression, an opposite axle yaw inducing force to the second axle responsive to a force externally inducing self-steering yaw of the first axle, and for urging said first and second axles into parallel spaced relationship upon removal of the externally induced self-steering yaw force.

14. The improved self-steering wheel truck of claim 13 wherein the diagonally disposed resilient axle alignment arms are curved.

15. The improved self-steering wheel truck of claim 13 wherein the diagonally disposed resilient axle alignment arms are pre-loaded in compression.

16. The improved self-steering wheel truck of claim 13 wherein the means for carrying the truck frame on the respective axle and wheel assembly comprises bearing housings.

17. An improved self-steering wheel truck of claim 1 wherein each generally vertically oriented tractive force transmitting shaft comprises part of an interconnecting assembly which forms the connection between diagonally disposed resilient axle alignment arms and each axle, wherein each interconnecting assembly comprises a transversely extending control arm pivotally connected at its ends to one end of each of the diagonally disposed resilient axle alignment arms, and fixably attached at its center to the upper end of a generally vertically oriented tractive force transmitting shaft;

a transversely extending steering beam fixably attached at its center to the lower end of the tractive force transmitting shaft; and a pair of connecting rods each pivotally connecting one end of the steering beam to the means for rotatably carrying the truck frame on an axle and wheel assembly.

18. The self-steering wheel truck of claim 17 wherein the pair of diagonally disposed resilient axle alignment arms are curved.

19. The self-steering wheel truck of claim 17 wherein the pair of diagonally disposed resilient axle alignment arms are pre-loaded in compression.

20. The improved self-steering wheel truck of claim 17 wherein the means for rotatably carrying the truck frame on the associated axle and wheel assembly comprises bearing housings.

21. The self-steering wheel truck of claim 1 wherein the pair of diagonally disposed resilient axle alignment arms are curved.

22. The self-steering wheel truck of claim 1 wherein the pair of diagonally disposed resilient axle alignment arms are pre-loaded in compression.

23. The improved self-steering wheel truck of claim 1 wherein the means for rotatably carrying said truck frame on the first and second axle and wheel assemblies comprises bearing housings.

24. An improved self-steering wheel truck for use with a railway locomotive or powered transit car, said self-steering wheel truck including first and second longitudinally spaced wheel and axle assemblies, each having a pair of opposing wheels interconnected by an axle, a truck frame including a pair of parallel side frames, defining a longitudinal axis, interconnected by at least two transverse frame members, defining a transverse axis, means for rotatably carrying said truck frame on said first and second axle and wheel assemblies and permitting axle yaw for both the first and second axles, tractive force motors drivedly connected to the axles for driving the wheels, wherein the improvement comprises:

a pair of generally vertically oriented tractive force transmitting shafts each connected to an axle and pivotally mounted to one of the transverse frame members for transmitting tractive force from the axle and wheel assembly to the truck frame and for rotation in response to axle yaw; and a pair of diagonally disposed curved resilient axle alignment arms, each connected to the first axle adjacent to a wheel and diagonally connected to the second axle adjacent to the corresponding opposing wheel, for transmitting, under compression, an opposite axle yaw inducing force to the second axle responsive to a force externally inducing self-steering yaw of the first axle, and for urging said first and second axles into parallel spaced relationship upon removal of the externally induced self-steering yaw force;

a pair of transversely oriented steering beams each for positioning in fixed parallel juxtaposed relationship to an axle;

a pair of connecting rods interconnecting each of said steering beams to an axle for positioning each control arm in fixed parallel juxtaposed relationship to an axle;

means for attaching a vertically oriented tractive force transmitting shaft to the centerpoint of each steering beam;

a pair of generally transverse control arms each fixedly connected, in opposing relationship, to an upper end of a generally vertically oriented tractive force transmitting shaft; and means for connecting the pair of diagonally disposed curved resilient axle alignment arms to opposite ends of the opposing control arms for transmitting, under compression, an opposite axle yaw inducing force to the second axle responsive to a force externally inducing self-steering yaw of the first axle, and for urging said first and second axles into parallel spaced relationship upon removal of the externally induced self-steering yaw force.

* * * * *